US011173728B2

(12) United States Patent
Yoda

(10) Patent No.: US 11,173,728 B2
(45) Date of Patent: Nov. 16, 2021

(54) BLOWING DEVICE AND RECORDING DEVICE

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/099,001

(22) Filed: Nov. 16, 2020

(65) Prior Publication Data

US 2021/0146704 A1 May 20, 2021

(30) Foreign Application Priority Data

Nov. 18, 2019 (JP) ..... JP2019-207708

(51) Int. Cl.
*B41J 11/00* (2006.01)
*B41J 29/377* (2006.01)

(52) U.S. Cl.
CPC ..... *B41J 11/00224* (2021.01); *B41J 11/0022* (2021.01); *B41J 11/00222* (2021.01); *B41J 29/377* (2013.01)

(58) Field of Classification Search
CPC ..... B41J 11/00224; B41J 11/0022; B41J 11/00222; B41J 29/377
See application file for complete search history.

(56) References Cited

U.S. PATENT DOCUMENTS

2016/0159111 A1* 6/2016 Sasaki ..... B41J 11/00222 347/102
2017/0072708 A1 3/2017 Miyashita et al.
2019/0100034 A1* 4/2019 Yoda ..... B41J 11/0022
2019/0184717 A1* 6/2019 Tsuji ..... B41J 11/0022

FOREIGN PATENT DOCUMENTS

JP 2015-217544 A 12/2015
JP 2019-107822 A 7/2019

* cited by examiner

*Primary Examiner* — Henok D Legesse
(74) *Attorney, Agent, or Firm* — Workman Nydegger

(57) ABSTRACT

A blowing device includes a housing including a blowing path, a fan, a first flow path member being fixed downstream of the fan, and including a first and a second air outlet that are arranged in a width direction, and a second flow path member being fixed downstream of the fan, and including a third and a fourth air outlet that are arranged in the width direction. The first and the second flow path member are fixed in a state of being arranged in the width direction, a fifth air outlet is formed between the first and the second flow path member that are fixed, and a part of an opening edge of the fifth air outlet is the first flow path member, and a part of the opening edge of the fifth air outlet is the second flow path member.

6 Claims, 7 Drawing Sheets

BLOWING DEVICE AND RECORDING DEVICE

The present application is based on, and claims priority from JP Application Serial Number 2019-207708, filed Nov. 18, 2019, the disclosure of which is hereby incorporated by reference herein in its entirety.

BACKGROUND

1. Technical Field

The present disclosure relates to a blowing device and a recording device.

2. Related Art

As described in JP-A-2019-107822, there has been known a heating device including a heating unit, an air outlet having a plurality of openings, and a blower for allowing gas to be blown out through the air outlet.

In a case where the heating device is mounted to a recording device that performs recording on a large medium, the air outlet is required to be lengthened in accordance with the medium in a width direction for the purpose of heating the entire medium in the width direction. However, the lengthened member requires high accuracy, which makes manufacturing difficult. Further, warpage is likely to be caused in the lengthened member. For example, when a gap is formed between the air outlet and a housing due to warpage, gas also leaks out through the gap. Thus, wind speed variation is caused in the width direction. In view of this, a configuration in which a plurality of members are arranged in a line in the width direction to constitute the air outlet is conceived. However, in this case, a thickness dimension of a defining wall that defines the openings of the members and a wall thickness dimension between the adjacent openings of the members when the members are arranged in a line are different from each other. Thus, there is a problem in that wind speed variation is caused in the width direction.

SUMMARY

A blowing device is configured to blow air toward a medium being applied with liquid and being transported in a transport direction, and includes a housing including a blowing path, a fan configured to blow air, the fan being provided on the blowing path, a first flow path member being fixed to the housing downstream of the fan in a blowing direction of the fan, and including a first air outlet and a second air outlet that are arranged in a width direction intersecting the transport direction, and a second flow path member being fixed to the housing downstream of the fan in the blowing direction, and including a third air outlet and a fourth air outlet that are arranged in the width direction. Further, the first flow path member and the second flow path member are fixed to the housing in the width direction, a fifth air outlet is formed between the first flow path member and the second flow path member that are fixed, and a part of an opening edge of the fifth air outlet is the first flow path member, and a part of the opening edge of the fifth air outlet is the second flow path member.

DESCRIPTION OF EXEMPLARY EMBODIMENTS

Figure 1:
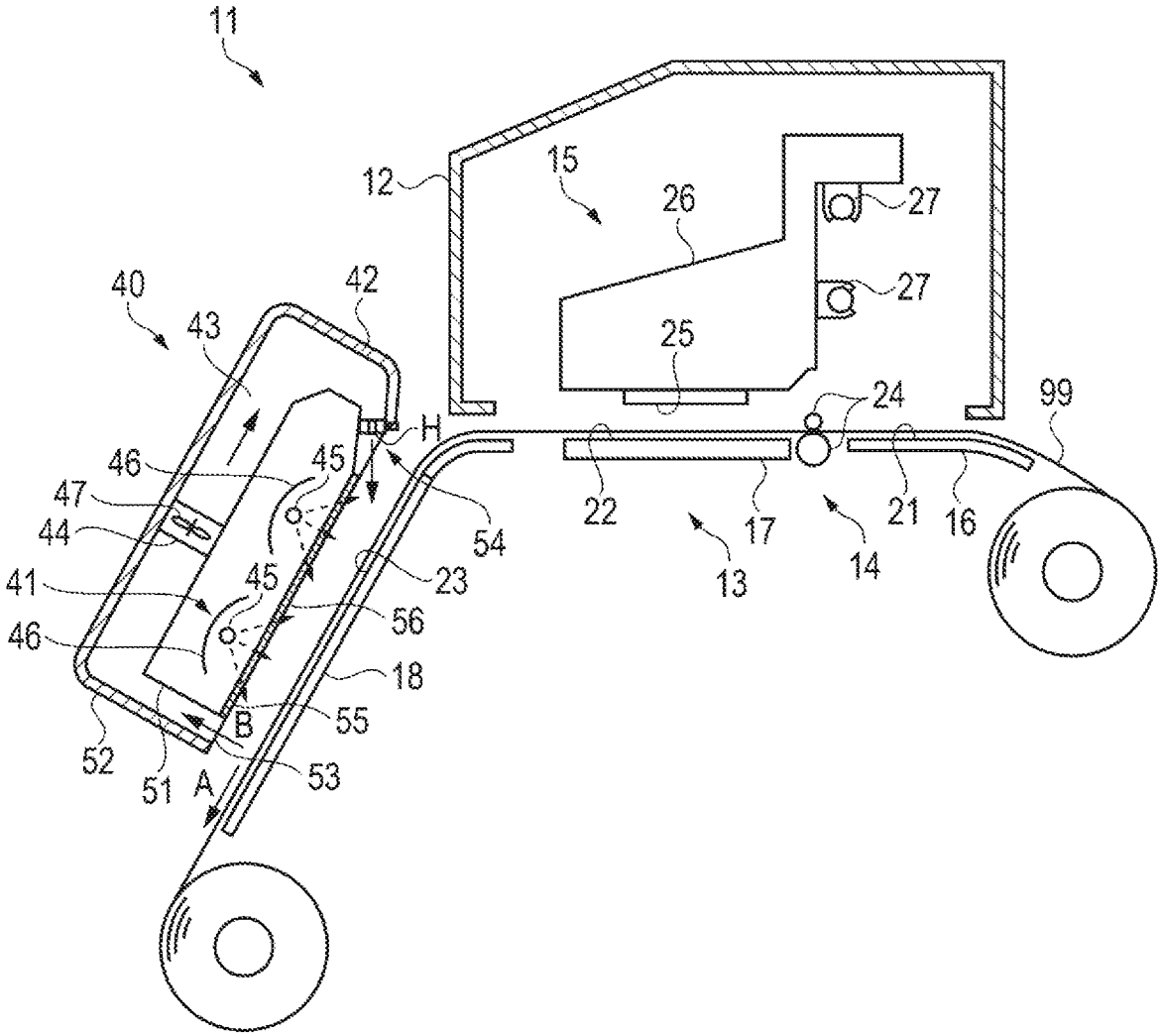
FIG. 1 is a schematic view illustrating a configuration of a recording device.

First, a configuration of a recording device 11 is described. FIG. 1 is a schematic view illustrating the configuration of the recording device 11. The recording device 11 is, for example, an ink jet-type printer that records (prints) an image of characters, photographs, and the like on a medium 99 such as a sheet by ejecting ink, which is an example of a liquid.

As illustrated in FIG. 1, the recording device 11 includes a container 12, a support unit 13 capable of supporting the medium 99, and a transport unit 14 that transports the medium 99 along the support unit 13. The recording device 11 includes a recording unit 15 disposed in the container 12, and a blowing device 40 disposed outside the container 12. The blowing device 40 blows gas onto the medium 99 to which the liquid is attached. The medium 99 is, for example, a roll paper wound in a cylindrical shape.

The support unit 13 includes a first support plate 16, a second support plate 17, and a third support plate 18. The first support plate 16, the second support plate 17, and the third support plate 18 are arranged in this order from an upstream side in a transport direction of the medium 99 transported by the transport unit 14.

The first support plate 16 and the second support plate 17 face the container 12. The surfaces of the first and second support plates 16 and 17, which face the container 12, are first and second support surface 21 and 22, respectively, that are configured to support the medium 99. The third support plate 18 faces the blowing device 40. The surface of the third support plate 18, which faces the blowing device 40, is the support surface 23 configured to support the medium 99. In the present exemplary embodiment, the surfaces of the first, second, and third support plates 16, 17, and 18, which face upward in a vertical direction, are defined as the support surfaces 21, 22, and 23.

The transport unit 14 includes, for example, a transport roller 24 that transports the medium 99 by rotating in contact with the medium 99. In the present exemplary embodiment, the transport roller 24 is disposed between the first support plate 16 and the second support plate 17 in the transport direction of the medium 99. The transport direction of the medium 99 transported by the transport unit 14 corresponds to the direction along the support surfaces 21, 22, and 23 of the first, second, and third support plates 16, 17, and 18.

The recording unit 15 includes a head 25 that ejects a liquid such as ink, for example. The head 25 is disposed to face the second support plate 17, and is capable of ejecting the liquid onto the medium 99 supported by the second support plate 17. The recording unit 15 is configured to record an image on the medium 99 by ejecting the liquid onto the medium 99. The recording unit 15 may include a carriage 26 that holds the head 25, and a guide shaft 27 that guides the movement of the carriage 26. In this case, the head 25 ejects ink while reciprocating with the carriage 26 along the guide shaft 27 extending in a width direction of the medium 99. The width direction of the medium 99 intersects the transport direction of the medium 99.

The blowing device 40 blows gas onto the medium 99 supported by the third support plate 18. Together with heating performed by a heating unit 41 described above, the blowing device 40 blows gas to promote evaporation of the liquid attached to the medium 99. In this manner, the medium 99 is dried.

The third support plate 18 supports the medium 99 downstream of the recording unit 15 in the transport direction of the medium 99. That is, the support surface 23 of the third support plate 18 is a surface configured to support the medium 99 to which the liquid is attached by the recording unit 15. The third support plate 18 of the present exemplary embodiment is inclined from an upper side toward a lower side in the vertical direction from the upstream side to the downstream side in the transport direction of the medium 99. That is, the third support plate 18 is disposed such that an upstream portion of the third support plate 18 in the transport direction is located on an upper side of a downstream portion of the third support plate 18.

The blowing device 40 is disposed to face the support surface 23 of the third support plate 18. The blowing device 40 is disposed slightly apart from the support surface 23 with a gap. Therefore, the medium 99 transported by the transport unit 14 passes through a region between the support surface 23 and the blowing device 40. The blowing device 40 dries the medium 99 that has an image recorded by the recording unit 15 and is transported by the transport unit 14.

The blowing device 40 includes the heating unit 41 configured to heat the medium 99, a housing 42 that accommodates the heating unit 41, a blowing path 43 through which gas flows, and a blower 44 configured to blow gas. The heating unit 41 heats the medium 99 supported by the support surface 23 of the third support plate 18. The heating unit 41 is disposed at a position facing the support surface 23. The heating unit 41 includes heating elements capable of generating heat. The heating elements are, for example, heater tubes 45 extending in the width direction of the medium 99. The two heater tubes 45 of the present exemplary embodiment are disposed side by side along the support surface 23.

The heating unit 41 may include reflection plates 46 for reflecting the heat of the heating element. In this case, the reflection plates 46 are preferably disposed to surround the portions of the heater tubes 45 on the opposite side to the support surface 23. The reflection plates 46 reflect infrared rays generated from the heater tubes 45 toward the support surface 23.

The housing 42 includes an inner wall 51 surrounding the heating unit 41, and an outer wall 52 surrounding the inner wall 51. The outer wall 52 is disposed outside the inner wall 51. The inner wall 51 and the outer wall 52 open toward the support surface 23. The inner wall 51 and the outer wall 52 form the blowing path 43.

The blowing path 43 is located outside the inner wall 51 and inside the outer wall 52. The blowing path 43 is disposed to surround the heating unit 41. The blowing path 43 includes an inlet 53 for taking gas into the blowing path 43, and a gas discharge unit 54 having a plurality of air outlets H for blowing out the gas in the blowing path 43. The gas discharge unit 54 is disposed downstream of the blowing direction of the blower 44. The inlet 53 and the air outlets H open toward the support surface 23. Note that, in the present exemplary embodiment, the blowing direction of the blower 44 corresponds to a direction along the blowing path 43 from the blower 44 to the support surface 23 via the air outlets H of the gas discharge unit 54.

The blower 44 is disposed in the blowing path 43. The blower 44 includes a fan 47 configured to generate airflow. The blower 44 causes the gas in the blowing path 43 to flow toward the gas discharge unit 54. The gas in the blowing path 43 is, for example, air. The blower 44 blows gas along the blowing path 43. The blower 44 blows out the gas flowing in through the inlet 53 from the air outlets H of the gas discharge unit 54. Note that, the blower 44 may include a plurality of fans 47.

The inlet 53 is located on the opposite side to the side where the recording unit 15 is located with respect to the heating unit 41. That is, the inlet 53 is located downstream of the heating unit 41 in the transport direction.

The gas discharge unit 54 is located on the side where the recording unit 15 is located with respect to the heating unit 41. That is, the gas discharge unit 54 is located on upstream of the heating unit 41 in the transport direction. The gas discharge unit 54 of the present exemplary embodiment is located on an upper side of the inlet 53.

The air outlets H of the gas discharge unit 54 open toward the opposite side to the side where the recording unit 15 is located. The downstream portion of the blowing path 43, which includes the gas discharge unit 54, extends to be inclined with respect to the support surface 23. The air outlets H of the gas discharge unit 54 of the present exemplary embodiment open in such a way to blow gas to the downstream side of the transport direction.

The gas blown out from the gas discharge unit 54 flows along the support surface 23 toward the opposite side to the side where the recording unit 15 is located. That is, after being blown onto the support surface 23, the gas blown out from the gas discharge unit 54 flows to the downstream side in the transport direction of the medium 99 on the support surface 23 as indicated by an arrow A in FIG. 1. In the present exemplary embodiment, the gas blown out from the gas discharge unit 54 flows from the upper side toward the lower side along the support surface 23.

A part of the gas blown out from the gas discharge unit 54 and flowing along the support surface 23 flows into the inlet 53 as indicated by an arrow B in FIG. 1, and a part of the gas is discharged to the outside of the blowing device 40 from a space between the inlet 53 and the support surface 23. That is, the blowing device 40 is configured such that a part of the gas blown out from the gas discharge unit 54 circulates inside the blowing device 40 through the blowing path 43.

The gas blown out from the gas discharge unit 54 and flowing into the inlet 53 is heated by the heating unit 41. Therefore, the inside of the blowing device 40 is less likely to be cooled compared to the case where the gas outside the blowing device 40 flows into the inlet 53. Thus, the temperature of the gas blown out from the gas discharge unit 54 is increased, and the inside of the blowing device 40 is easily maintained at a high temperature. Further, the blowing path 43 is located to surround the heating unit 41, and thus, the temperature in the blowing path 43 increases due to the heat generated from the heating unit 41. In this way, the heat generated by the heater tube 45 can be collected and reused for drying, the heat loss of the blowing device 40 is suppressed, and the thermal efficiency is improved.

When the heating unit 41 heats the medium 99, vapor is generated by the evaporation of the liquid attached to the medium 99. When the humidity inside the blowing device 40 is increased due to the vapor, the medium 99 is hard to dry. Therefore, the blowing device 40 discharges the vapor with a part of the gas blown out from the gas discharge unit 54 to the outside of the blowing device 40 from the space between the inlet 53 and the support surface 23. Thus, the increase in humidity inside the blowing device 40 is suppressed.

The blowing device 40 dries the medium 99 by blowing gas onto the medium 99 while the heating unit 41 heats the medium 99 supported by the support surface 23. That is, when the recorded medium 99 is transported along the support unit 13 and reaches the region between the blowing device 40 and the support surface 23, the evaporation of the liquid attached to the medium 99 is promoted by the heat generated by the heater tube 45 and the gas blown out from the gas discharge unit 54.

The inner wall 51 includes an opening 55 facing the support surface 23. A wire mesh 56 is preferably disposed in the opening 55. In the configuration in which the wire mesh 56 is disposed in the opening 55, the heat of the heater tube 45 is transmitted to the medium 99 on the support surface 23 via the wire mesh 56. Further, a part of the gas blown out from the gas discharge unit 54 flows along the wire mesh 56 in the transport direction.

Next, a detailed configuration of the gas discharge unit 54 is described below.

Figure 2:
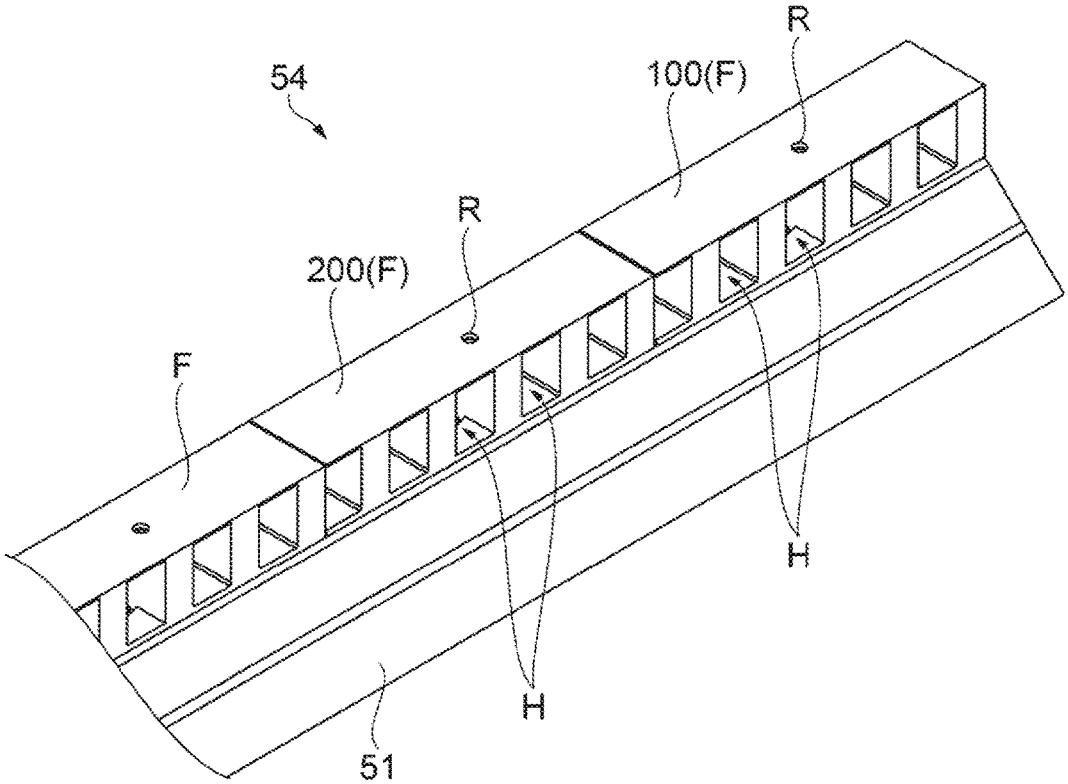
FIG. 2 is a perspective view illustrating a configuration of a gas discharge unit.

FIG. 2 is a perspective view illustrating the configuration of the gas discharge unit 54. Note that, in FIG. 2, a state in which the outer wall 52 of the housing 42 is omitted and the gas discharge unit 54 is fixed to the inner wall 51 is illustrated. Further, FIG. 2 illustrates a state in which the gas discharge unit 54 is seen from the blower 44 side.

As illustrated in FIG. 2, the gas discharge unit 54 is formed of a plurality of flow path members F. The plurality of flow path members F are disposed in a line in the width direction intersecting the transport direction of the medium 99. In the example in FIG. 2, a first flow path member 100 and a second flow path member 200 are arranged in a line along the width direction. The first flow path member 100 and the second flow path member 200 are disposed to have a width direction as a longitudinal direction. A dimension of the gas discharge unit 54 in the width direction, which is formed of the plurality of flow path members F, is substantially the same as a dimension of the third support plate 18 in the width direction. Each of the flow path members F constituting the gas discharge unit 54 has a similar mode. The flow path member F is formed of a thermoplastic resin, for example. Each of the flow path members F is provided with the plurality of air outlets H for discharging gas in the blowing path 43.

The gas discharge unit 54 has a configuration in which the plurality of flow path members F are provided and the flow path members F are arranged in a line in the width direction. Thus, for example, as compared to a case where the gas discharge unit 54 is lengthened in the width direction, manufacturing is easier, and warpage is less likely to be caused. Thus, a gap is less likely to be formed between the housing 42 and the gas discharge unit 54, and variation in wind speed blown from the gas discharge unit 54 in the width direction can be suppressed.

Further, when the fan 47 of the blower 44 is an axial flow fan, variation in wind speed is likely to be caused in the fan 47 between a region corresponding to an axial part and a region corresponding to a blade part. However, when the flow path member F having the plurality of air outlets H is disposed, gas is likely to be discharged evenly through each of the air outlets H, and hence wind speed variation can be suppressed.

Further, when the plurality of flow path members F constitute the gas discharge unit 54, the gas discharge unit 54 can be shared by other blowing devices having dimensions different in the width direction by, for example, changing the number of the flow path members F installed in the width direction.

Further, in the blowing device 40 of the present exemplary embodiment, the blower 44 and the gas discharge unit 54 are disposed apart from each other. Further, the one common blowing path 43 is provided between the blower 44 and the gas discharge unit 54. Thus, the number of fans 47 is not limited with respect to the number of flow path members F.

Figure 3:
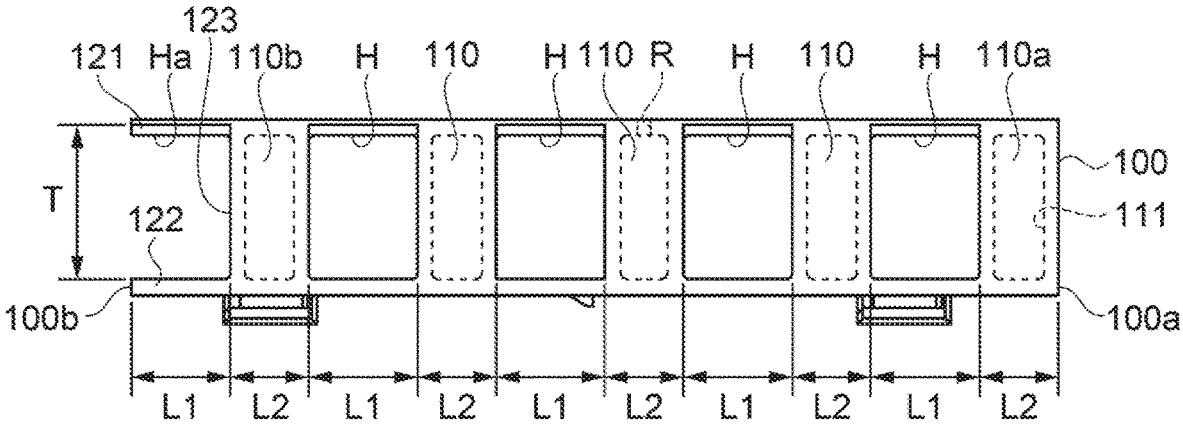
FIG. 3 is a front view illustrating a configuration of a first flow path member.
Figure 4:
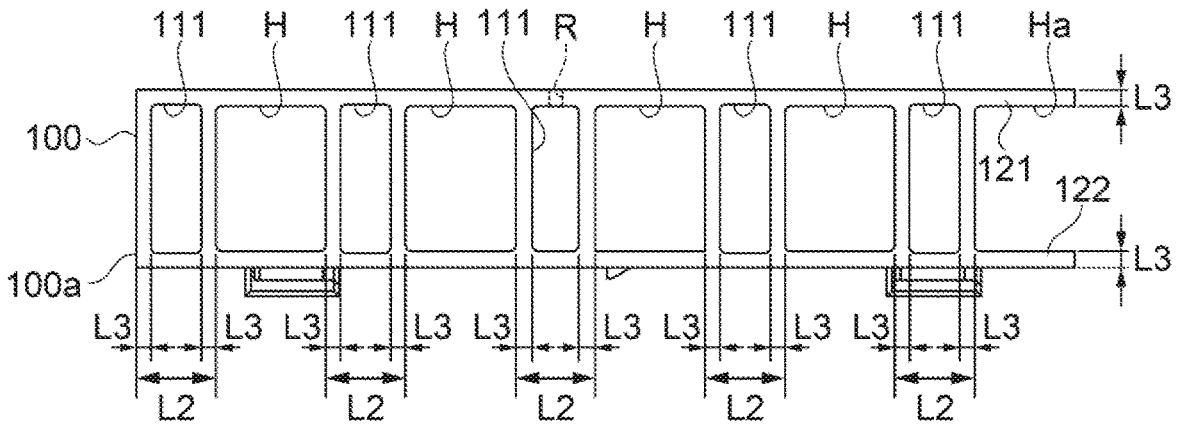
FIG. 4 is a back view illustrating the configuration of the first flow path member.
Figure 5:
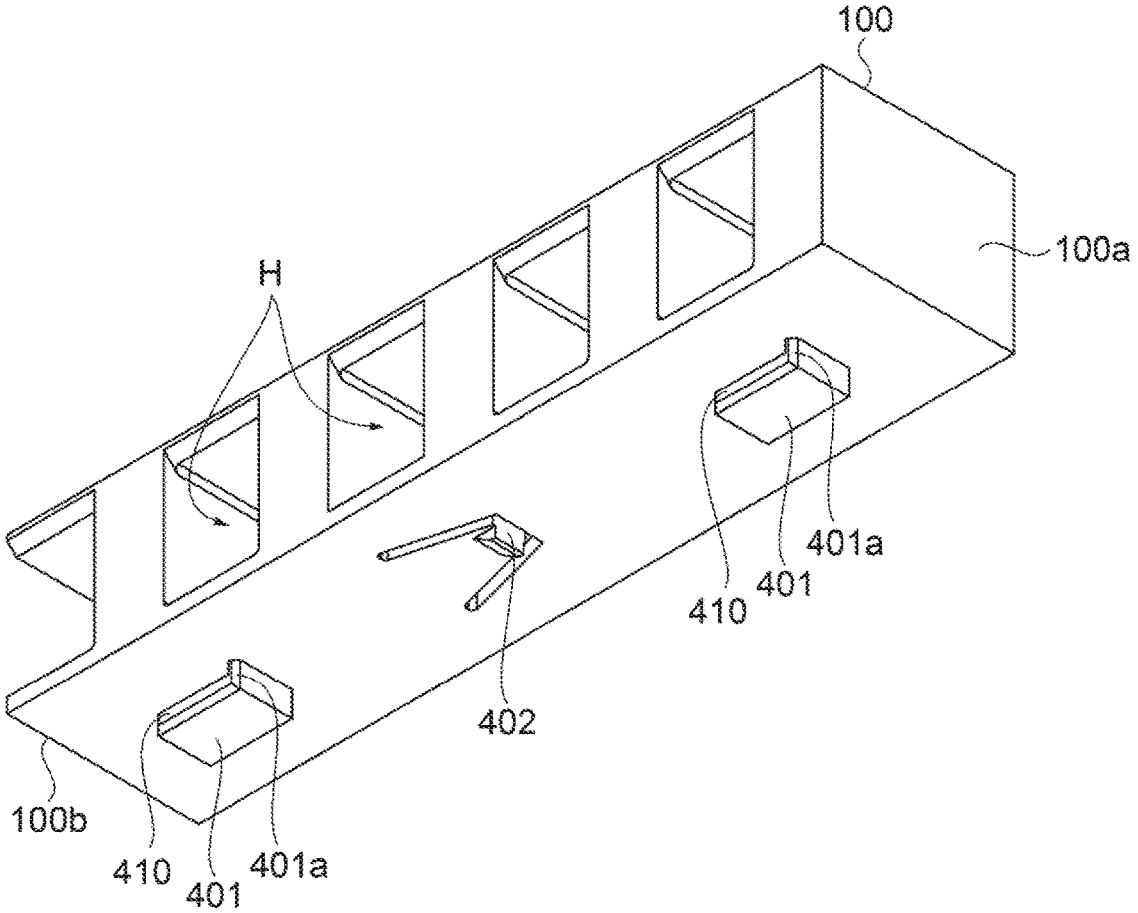
FIG. 5 is a perspective view illustrating the configuration of the first flow path member.

Next, a configuration of each of the flow path members F is described. Note that each of the flow path members F has a similar mode, and hence the configuration of the first flow path member 100 is described as an example. FIG. 3 to FIG. 5 illustrate the configuration of the first flow path member 100. FIG. 3 is a front view, FIG. 4 is a back view, and FIG. 5 is a perspective view. Note that FIG. 3 illustrates a state of viewing the first flow path member 100 from the blower 44 side, FIG. 4 illustrates a state of viewing the first flow path member 100 from the third support plate 18 side, and FIG. 5 illustrates a state of viewing FIG. 3 diagonally from a lower side.

As illustrated in FIG. 3 to FIG. 5, the first flow path member 100 has a substantially rectangular parallelepiped form having a width direction as a longitudinal direction. The plurality of air outlets H being through holes are provided in the first flow path member 100. In the present exemplary embodiment, the four air outlets H are provided. The air outlets H are arranged in the width direction. Further, each of the air outlets H has a similar shape. Specifically, the air outlet H has a rectangular shape in a front view.

As illustrated in FIG. 3, a defining wall 110 that defines each of the air outlets H is provided between the adjacent air outlets H. Further, the air outlets H are disposed at an equal interval. Specifically, in the width direction, a width dimension of the air outlet H is L1, and a width dimension of the defining wall 110 is L2. Thus, the air outlets H are disposed at an interval equivalent to the width dimension L2 of the defining wall. Further, a height dimension in a height direction intersecting the width direction of the air outlets H is T.

Further, a defining wall 110*a* having the width dimension L2 is provided between one end surface 100*a* of the first flow path member 100 in the width direction and the air outlet H provided at a position closest to the one end surface 100*a*.

Meanwhile, a groove portion Ha in a U-like shape is provided in another end 100*b* on the opposite side to the one end surface 100*a* of the first flow path member 100 in the width direction. A defining wall 110*b* having the width dimension L2 is provided between the groove portion Ha and the adjacent air outlets H. The groove portion Ha is defined by a projection portion 121 projecting from the upper part of the defining wall 110*b* in the width direction, a projection portion 122 projecting from the lower part of the defining wall 110*b* in the width direction, and one surface 123 of the defining wall 110*b*, and opens in the width direction. Further, the width dimension of the groove portion Ha is L1, the height dimension is H, which are similar to the dimensions of the air outlets H. That is, for example, when the defining wall 110 is provided to the groove portion Ha on the other end 100*b* side, the groove portion Ha may have a configuration similar to that of the air outlet H.

As illustrated in FIG. 4, defining wall 110, 110*a*, and 110*b* are subjected to hollowing-out treatment, and hollow portions 111 are formed. When the hollow portion 111 is formed, the thickness dimension of the defining wall 110 is reduced. Specifically, the thickness dimension of each of the defining walls 110 is L3. Further, the thickness dimensions of the upper part and the lower part of the hollow portion 111 are also L3. Further, the thickness dimension of each of the projection portions 121 and 122 is also L3. That is, the thickness dimension of each part of the first flow path member 100 is formed uniformly in L3. With this, formation of the first flow path member 100 is facilitated. Further, formation of warpage or the like of the first flow path member 100 can be suppressed.

Further, a screw hole R for allowing a screw V being a fastening member to pass therethrough is provided in the upper part of the first flow path member 100. The screw hole R is a hole passing from the upper surface of the first flow path member 100 to the hollow portion 111. The screw V fastens the outer wall 52 and the first flow path member 100 to each other. A through hole is provided in the outer wall 52 at a position corresponding to the screw hole R. Under a state in which the outer wall 52 and the first flow path member 100 are arranged, the screw V is inserted from the outer wall 52 side toward the hollow portion 111. With this, the outer wall 52 and the first flow path member 100 are fastened to each other (see FIG. 8). The screw V is prevented from being disposed in the air outlet H. Thus, the screw V does not hinder gas from being discharged, and a pressure loss difference between the air outlets H can be reduced. Note that the outer wall 52 and the first flow path member 100 are fastened to each other with the screw V, but the exemplary embodiment is not limited thereto. The outer wall 52 and the first flow path member 100 may be fastened to each other by providing a projection portion to the outer wall 52 at the position corresponding to the screw hole R of the first flow path member 100 and fitting the projection portion into the screw hole R.

As illustrated in FIG. 5, the lower surface of the first flow path member 100, that is, the surface held in contact with the inner wall 51 is provided with protrusion portions 401 and 402 for connection with the inner wall 51. The protrusion portion 401 is provided each on the one end surface 100*a* side and the other end 100*b* side of the first flow path member 100. The protrusion portion 402 is provided between both the disposed protrusion portions 401. A slide groove 410 along the width direction is provided in the protrusion portion 401. The slide groove 410 is formed to have a thickness dimension larger than the thickness dimension of the inner wall 51. Further, a regulating portion 401*a*, which is formed to have a width larger than the slide groove 410, is provided to the slide groove 410 on the one end surface 100*a*.

Figure 6:
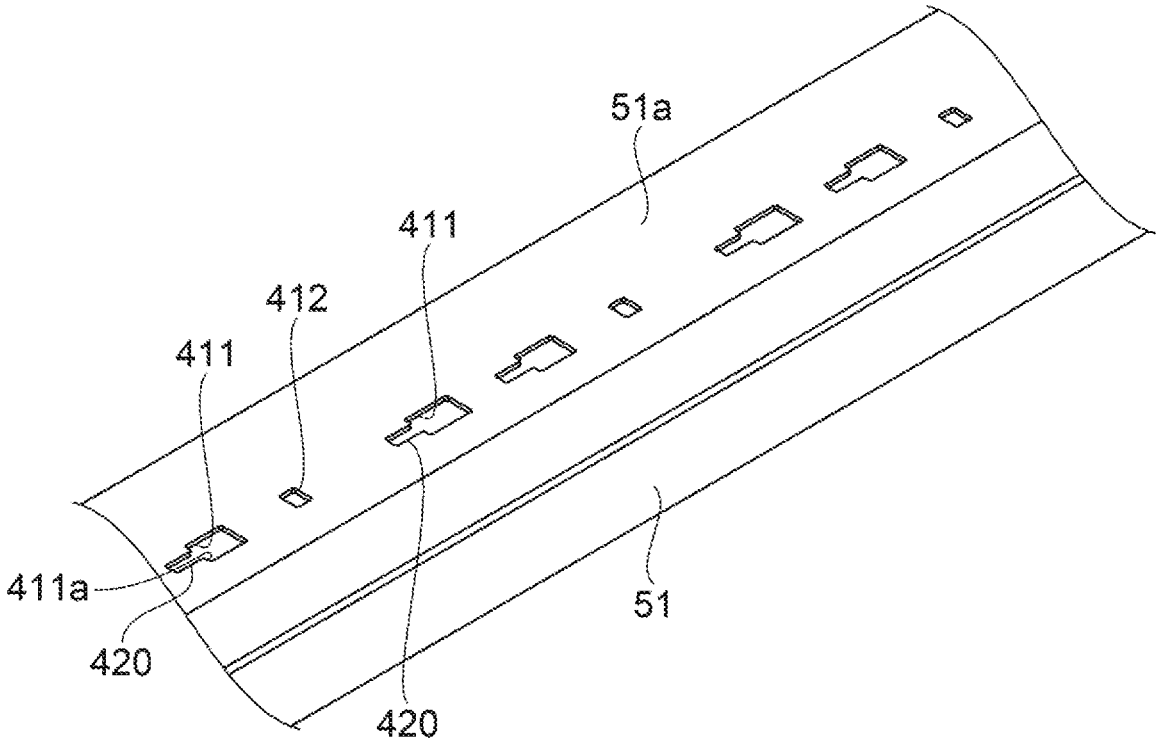
FIG. 6 is a perspective view illustrating a part of a configuration of a housing.

FIG. 6 is a perspective view illustrating a part of the configuration of the housing 42, and illustrates a portion corresponding to an inner wall surface 51*a* of the inner wall 51, which is held in contact with the first flow path member 100. the inner wall 51 has through holes 411 engaged with the protrusion portions 401 and a through hole 412 into which the protrusion portion 402 is fitted. A small opening width portion 420 is provided to the through hole 411. The small opening width portion 420 and the slide groove 410 are engaged with each other.

Figure 7:
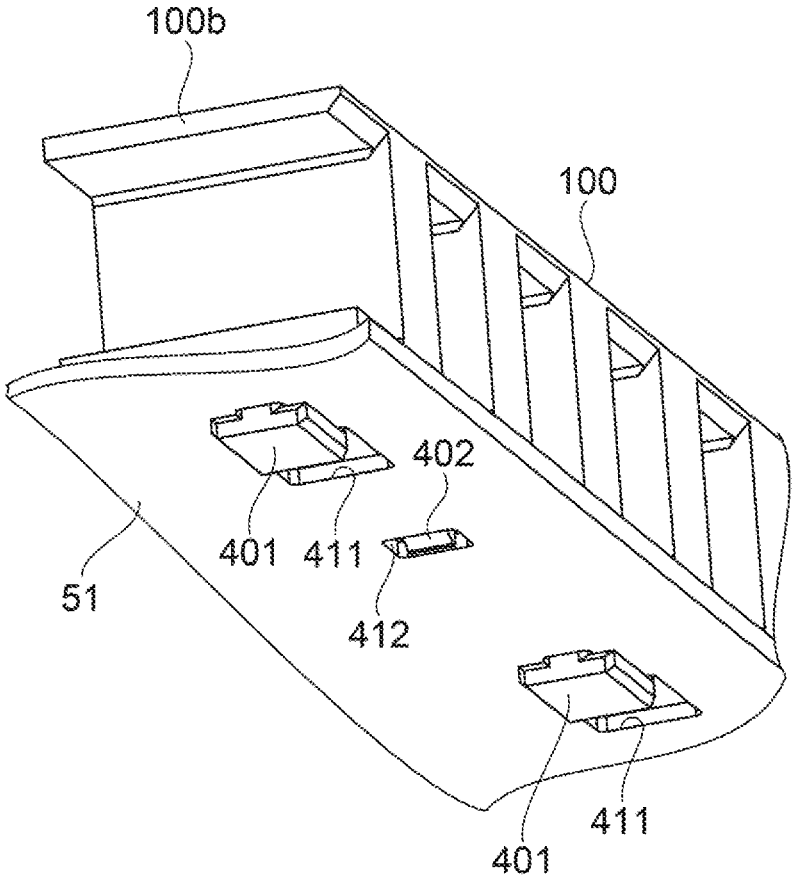
FIG. 7 is a perspective view illustrating a connection state between the first flow path member and the housing.

FIG. 7 is a perspective view illustrating a connection state between the first flow path member 100 and the housing 42, and illustrates a connection state between the first flow path member 100 and the inner wall 51.

Here, a connection method of connecting the first flow path member 100 and the inner wall 51 to each other is described.

First, both the protrusion portions 401 of the first flow path member 100 are inserted into both the through holes 411. After that, the first flow path member 100 moves to the other end 100*b* side. With this, the slide groove 410 moves while being guide by the small opening width portion 420 of the through hole 411. Further, the regulating portion 401*a* of the protrusion portion 401 is held in contact with a regulating surface 411*a* being a boundary between the small opening width portion 420 and the large opening width portion of the through hole 411. With this, motion of the first flow path member 100 is regulated. Further, in this case, the protrusion portion 402 is fitted into the through hole 412. With this, the first flow path member 100 and the inner wall 51 are connected to each other under a state in which the placement positions are fixed.

Note that in a case where another flow path member F is attached to the inner wall 51 after the flow path member F is connected to the inner wall 51, the same method described above is performed in the same attachment direction as the flow path member F that is connected in advance. Subsequently, the flow path members F are attached one after another, and thus the gas discharge unit 54 is formed.

As compared to a case where the first flow path member 100 and the inner wall 51 are connected to each other, for example, with a fastening member such as a screw, the attachment method is simple, and the time period required for attachment work can be reduced.

Meanwhile, in a case where each of the flow path members F is detached from the inner wall 51, detachment work can be performed easily by moving the flow path member F that is lastly attached to the inner wall 51 in the opposite direction from the attachment method described above.

Figure 8:
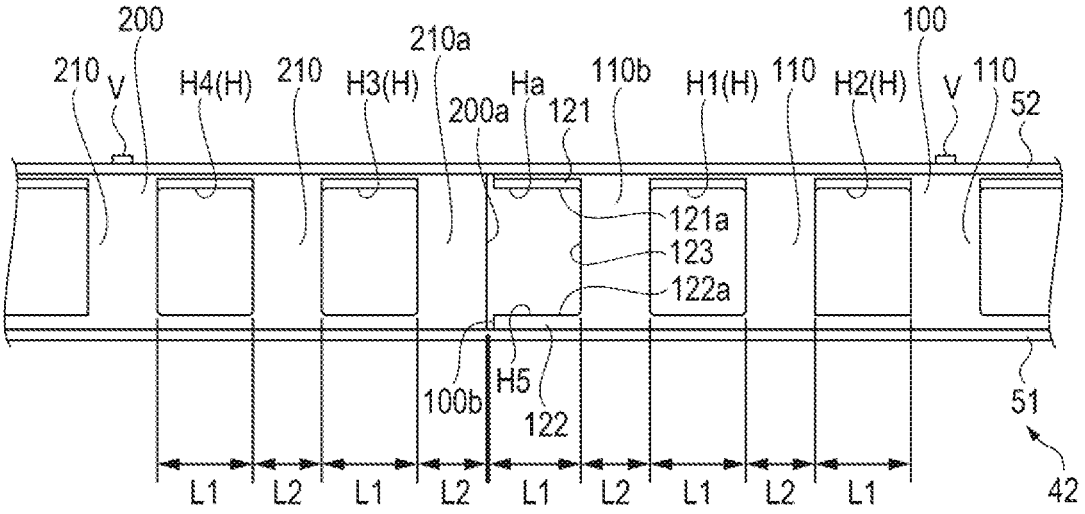
FIG. 8 is a front view illustrating a placement state of the gas discharge unit.

Next, a state in which the gas discharge unit 54 is disposed in the housing 42 is described. FIG. 8 is a front view illustrating a placement state of the gas discharge unit 54. FIG. 8 is a view from the blower 44 side. Note that a configuration of a part between the first flow path member 100 and the second flow path member 200 is described below. In the gas discharge unit 54, the first flow path member 100 and the second flow path member 200 are disposed to be oriented similarly in the width direction. In the present exemplary embodiment, the configuration of the part between the other end 100*b* side of the first flow path member 100 and one end surface 200*a* side of the second flow path member 200 is described.

As illustrated in FIG. 8, the first flow path member 100 has the air outlets H including a first air outlets H1 and a second air outlets H2. Further, the groove portion Ha is provided on the other end 100*b* side of the first flow path member 100.

The second flow path member 200 arranged on the other end 100*b* side of the first flow path member 100 has the air outlets H including the third air outlet H3 and a fourth air outlet H4. Further, the second flow path member 200 has the one end surface 200*a* on the other end 100*b* side of the first flow path member 100. Further, a defining wall 210*a* is provided between the one end surface 200*a* and the third air outlet H3 provided at a position closest to the one end surface 200*a*. Note that the first flow path member 100 and the second flow path member 200 have the same configuration. For example, the third air outlet H3, the fourth air outlet H4, the one end surface 200*a*, and the defining wall 210*a* of the second flow path member 200 have the same configurations as those of the first air outlets H1, the second air outlet H2, the one end surface 100*a*, and the defining wall 110*a* of the first flow path member 100.

A fifth air outlet H5 is formed between the first flow path member 100 and the second flow path member 200 that are fixed to the housing 42. A part of an opening edge of the fifth air outlet H5 is the first flow path member 100, and a part of the opening edge of the fifth air outlet H5 is the second flow path member 200. That is, the part of the first flow path member 100 and the part of the second flow path member 200 constitute the fifth air outlet H5. In the present exemplary embodiment, the fifth air outlet H5 is formed to be defined by the groove portion Ha of the first flow path member 100 and the one end surface 200*a* of the second flow path member 200.

More specifically, the one surface 123 of the defining wall 110*b*, which is one side of the opening edge forming the groove portion Ha of the first flow path member 100 and the one end surface 200*a* being one side of the opening edge in the second flow path member 200 face each other in the width direction. Further, inner surfaces 121*a* and 122*a* of the projection portions 121 and 122, which are sides of the groove portion Ha extending in the width direction, are disposed between the one surface 123 of the defining wall 110*b* and the one end surface 200*a*. With this, the fifth air outlet H5 is formed. That is, the fifth air outlet H5 is defined by the one surface 123, the inner surfaces 121*a* and 122*a*, and the one end surface 200*a*, which form the opening edge of the groove portion Ha. Thus, the fifth air outlet H5 of the present exemplary embodiment has a rectangular shape similarly to the other first, second, third, fourth air outlets H1, H2, H3, and H4.

Further, the dimensions of the projection portions 121 and 122 of the groove portion Ha in the width direction are L1. Further, the dimension of the defining wall 210*a* in the width direction is L2. Thus, the fifth air outlet H5 formed by the groove portion Ha and the defining wall 210*a* has the same dimension as the other first, second, third, fourth air outlets H1, H2, H3, and H4. Further, the fifth air outlet H5 is sandwiched between the defining walls 110*b* and 210*a*. Thus, under a state in which the first flow path member 100 and the second flow path member 200 are fixed to the housing 42, the first air outlets H1, the fifth air outlet H5, the third air outlet H3, the fourth air outlet H4 are disposed at an equal interval from the second air outlet H2.

That is, for example, in a case where the first flow path member 100 is disposed in the opposite direction in the width direction, and the first flow path member 100 and the second flow path member 200 face each other with the defining wall 110*a* and the defining wall 210*a*, the width dimension of the part in which the first flow path member 100 and the second flow path member 200 are adjacent to each other in the width direction is twice as large as L2, which is larger than the width dimension L2 of the defining wall 110 or the like in the width direction. Consequently, as compared to the other parts, a wind speed is largely reduced at the thick part in which the first flow path member 100 and the second flow path member 200 are adjacent to each other. With this, wind speed variation in the width direction is disadvantageously wide. Further, in a case where the defining walls 110*a* and 210*a* face each other, a gap in a slit-like shape is formed between the defining walls 110*b* and 210*a* due to tolerance variation of each of the first flow path member 100 and the second flow path member 200. Thus, wind speed variation in the width direction is caused.

Meanwhile, in the present exemplary embodiment, the groove portion Ha of the first flow path member 100 and the defining wall 210*a* of the second flow path member 200 face each other to form the fifth air outlet H5, and hence the dimension of the part in which the first flow path member 100 and the second flow path member 200 are adjacent to each other is not increased. Thus, at the part in which the first flow path member 100 and the second flow path member 200 are adjacent to each other, reduction in wind speed is suppressed. Thus, wind speed variation in the width direction can be suppressed. Wind speed variation in the width direction is suppressed. With this, variation in degree at which evaporation of the liquid is promoted is suppressed, and uneven drying of the medium 99 is less likely to be caused.

Further, particularly, when wind speed variation in the width direction is suppressed with regard to a wind blowing onto the heated medium 99 as in the present exemplary embodiment, variation in surface temperature of the medium 99 is suppressed. For example, when the heating unit 41 is controlled with reference to a region having a surface temperature lower than that in other regions, there is a risk in that excessive heating may be performed in a region having a surface temperature higher than that in the region. Therefore, by suppressing wind speed variation, excessive heating of the medium 99 can be suppressed, damage of the medium 99 can be reduced, and the liquid attached to the medium 99 can be dried.

Note that, in the present exemplary embodiment, the first flow path member 100 and the second flow path member 200 may be arranged to be slightly apart from each other.

When the heated gas is sent from the blower 44 to the gas discharge unit 54, the first flow path member 100 and the second flow path member 200 are thermally expanded in the width direction due to the heating unit 41. In the present exemplary embodiment, the first flow path member 100 and the second flow path member 200 are disposed apart from each other. Thus, both the flow path members 100 and 200 are held in contact with each other due to thermal expansion, a wind speed is little. That is, the fifth air outlet H5 formed by the first flow path member 100 and the second flow path member 200 opens in a space filled with the heated gas. Thus, even when thermal expansion is caused, the opening of the fifth air outlet H5 is changed only at a small degree. Thus, wind speed variation can be suppressed. Further, tolerance variation of the first flow path member 100 and the second flow path member 200 can be absorbed.

Figure 9:
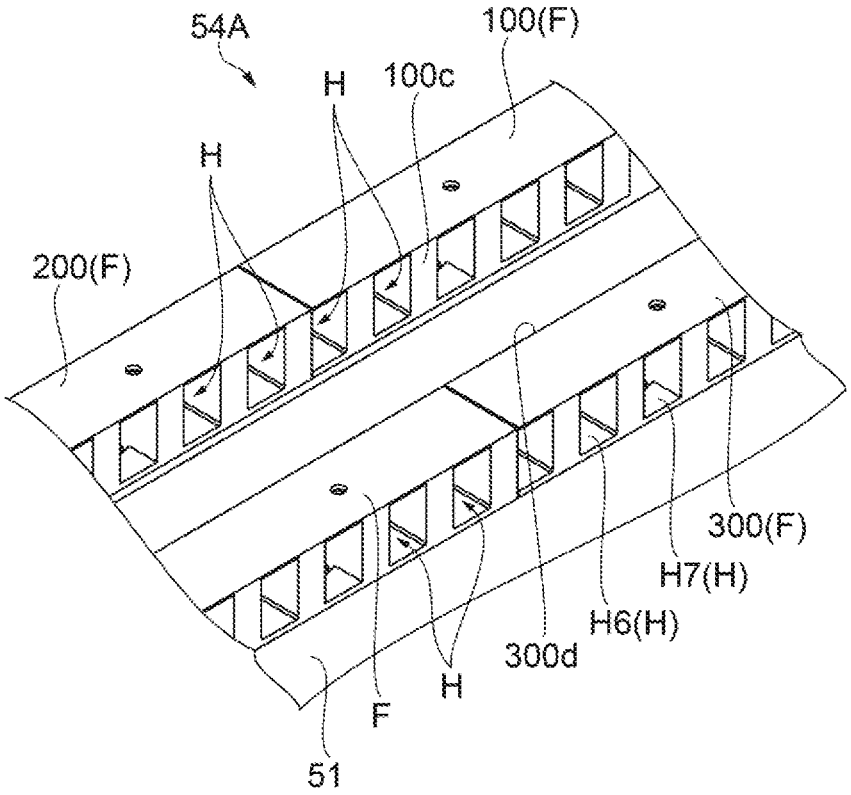
FIG. 9 is a perspective view illustrating a configuration of another gas discharge unit.

Next, a configuration of another gas discharge unit 54A is described. FIG. 9 is a perspective view illustrating the configuration of the other gas discharge unit 54A. Note that, in FIG. 9, a state in which the outer wall 52 of the housing 42 is omitted and the gas discharge unit 54A is connected to the inner wall 51 is illustrated. Further, FIG. 9 illustrates a state in which the gas discharge unit 54A is seen from the blower 44 side.

As illustrated in FIG. 9, the gas discharge unit 54A is formed of the plurality of flow path members F. the plurality of flow path members F are disposed in a plurality of lines in the width direction intersecting the transport direction of the medium 99. First, the first flow path member 100 and the second flow path member 200 are arranged in a line in the width direction. Further, a third flow path member 300 is disposed downstream of the blower 44 in the blowing direction and on upstream of the first and second flow path members 100 and 200. The third flow path member 300 is disposed to have a width direction as a longitudinal direction. The third flow path member 300 has a sixth air outlet H6 and a seventh air outlet H7, and has a basic configuration similar to that of the first flow path member 100.

Further, the first flow path member 100 and the third flow path member 300 are apart from each other in the blowing direction. Specifically, an inlet surface 100*c* having, among the air outlets H of the first flow path member 100, inlets through which gas sent from the blower 44 flows in and an air outlet surface 300*d* having, among the air outlets H of the third flow path member 300, air outlets through which the gas flows out are apart from each other. Note that the first flow path member 100 and the third flow path member 300 may be disposed in such a way that each of the air outlets H of the first flow path member 100 and each of the sixth and seventh air outlets H6 and H7 of the third flow path member 300 match each other in the blowing direction. Alternatively, the first flow path member 100 and the third flow path member 300 may be disposed in such a way that the air outlets H of the first flow path member 100 and the air outlets H of the third flow path member 300 are shifted in the width direction with respect to the blowing direction by a dimension being a width dimension L1/2 of the air outlets H, for example. With this, a pressure loss is adjusted, and hence a wind speed in accordance with an output of the fan 47 of the blower 44 and a state of the medium 99 can be obtained. Further, the first flow path member 100 and the third flow path member 300 are apart from each other. Thus, wind speed variation can be suppressed.

Figure 10:
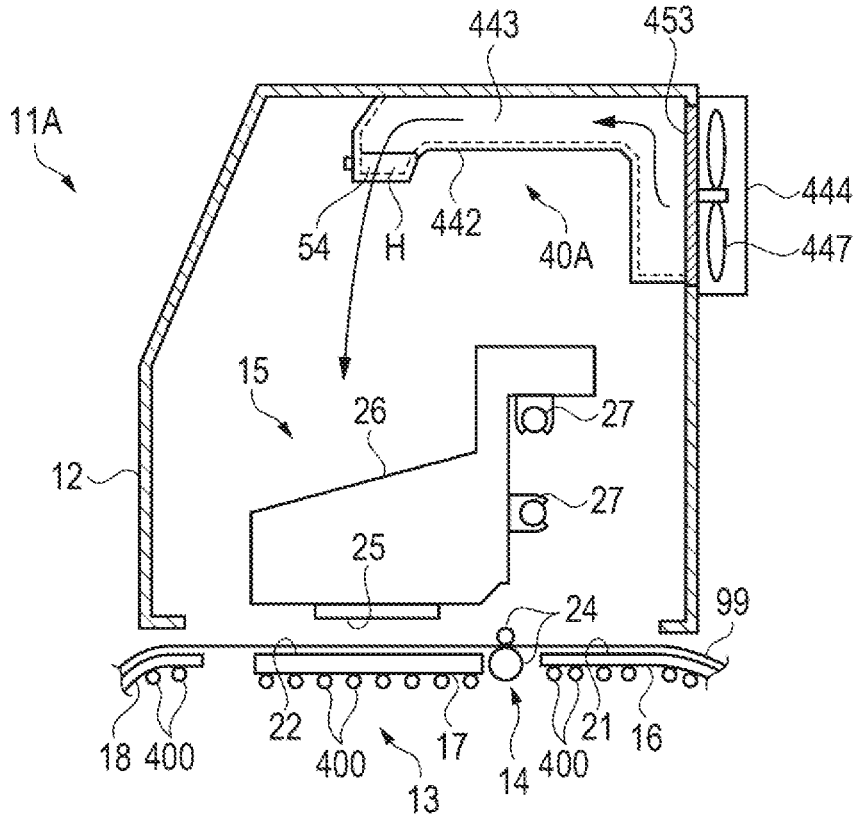
FIG. 10 is a schematic view illustrating a configuration of another recording device.

Next, a configuration of another recording device 11A is described. FIG. 10 is a schematic view illustrating the configuration of the other recording device 11A.

The recording device 11 of the exemplary embodiment described above has a configuration including the blowing device 40 configured to blow air toward the medium 99 transported to the third support plate 18. In contrast, the recording device 11A of the present exemplary embodiment has a configuration including a blowing device 40A configured to blow air particularly onto the second support plate 17.

As illustrated in FIG. 10, the recording device 11A includes the container 12, the support unit 13 capable of supporting the medium 99, and the transport unit 14 that transports the medium 99 along the support unit 13. The recording device 11A includes the recording unit 15 disposed in the container 12, and the blowing device 40A configured to blow air toward the support unit 13 from the inside of the container 12. Note that the configurations of the support unit 13, the transport unit 14, and the recording unit 15 are similar to those of the exemplary embodiment described above, and hence description thereof is omitted.

In the present exemplary embodiment, a heater 400 configured to heat the first support plate 16, the second support plate 17, and the third support plate 18. The heater 400 is a tube heater, for example. By heating the first support plate 16, the second support plate 17, and the third support plate 18, drying of the liquid attached to the medium 99 can be promoted.

The blowing device 40A performs blowing onto the second support plate 17, and suppresses temperature variation in a scanning direction along the guide shaft 27.

The blowing device 40A includes a housing 442, a blowing path 443 through which gas flows, and a blower 444 configured to blow gas.

The housing 442 and the container 12 form the blowing path 443. The blowing path 443 includes the gas discharge unit 54 having the plurality of air outlets H for blowing out gas in the blowing path 443. The gas discharge unit 54 is disposed downstream of the blowing direction of the blower 444. The plurality of air outlets H of the gas discharge unit 54 open toward the support unit 13. In the present exemplary embodiment, the plurality of air outlets H mainly open toward the second support plate 17. The gas discharge unit 54 of the present exemplary embodiment has a width equivalent to the width of the support unit 13. Note that the basic configuration of the gas discharge unit 54 is similar to that of the exemplary embodiment described above.

The blower 444 is disposed outside of the container 12. The blower 444 includes a fan 447 configured to generate airflow. The blower 444 blows gas along the blowing path 443. The blower 444 blows out the gas flowing in through the inlet 453 from the air outlets H of the gas discharge unit 54. The air outlets H of the gas discharge unit 54 open in such a way to blow gas to the second support plate 17 side.

The gas discharged from the gas discharge unit 54 flows from the upper side of the recording unit 15 toward the second support plate 17. Blowing is performed onto the second support plate 17 from the gas discharge unit 54 while suppressing wind speed variation in the width direction. With this, a temperature at the second support plate 17 and the vicinity thereof is uniformed. Thus, temperature variation on the medium 99 heated by the heater 400 can be suppressed, and quality of an image recorded on the medium 99 can be improved.

Note that the shape of the air outlets H including the fifth air outlet H5 of the gas discharge units 54 and 54A of the exemplary embodiments described above is rectangular in a front view, but is not limited thereto. For example, in a front view, the shape of the air outlets H including the fifth air outlet H5 may be an elliptical shape having a curved surface, a triangular shape, or the like.

Contents derived from the exemplary embodiments are described below.

A blowing device is configured to blow air toward a medium being applied with liquid and being transported in a transport direction, and includes a housing including a blowing path, a fan configured to blow air, the fan being provided on the blowing path, a first flow path member being fixed to the housing downstream of the fan in a blowing direction of the fan, and including a first air outlet and a second air outlet that are arranged in a width direction intersecting the transport direction, and a second flow path member being fixed to the housing downstream of the fan in the blowing direction, and including a third air outlet and a fourth air outlet that are arranged in the width direction. The first flow path member and the second flow path member are fixed to the housing in a state of being arranged in the width direction, a fifth air outlet is formed between the first flow path member and the second flow path member that are fixed, and a part of an opening edge of the fifth air outlet is the first flow path member, and a part of the opening edge of the fifth air outlet is the second flow path member.

With this configuration, the plurality of flow path members are provided, and the flow path members are arranged in a line in the width direction. Thus, for example, as compared to a case where the flow path member is lengthened in the width direction, manufacturing is easier, and warpage is less likely to be caused. Thus, a gap is less likely to be formed between the housing and the flow path members. Thus, wind speed variation in the width direction can be suppressed. Further, when the first flow path member and the second flow path member are installed by being arranged in the width direction, at the part in which both the flow path members are adjacent to each other, the part of the first flow path member and the part of the second flow path member constitute the fifth air outlet. That is, the parts in which the first flow path member and the second flow path member face each other are not the outer walls of both the flow path members. Thus, the part in which the first flow path member and the second flow path member are adjacent to each other is not increased in dimension. Thus, at the part in which the first flow path member and the second flow path member are adjacent to each other, reduction in wind speed is suppressed. Thus, wind speed variation in the width direction can be suppressed.

In the blowing device described above, the first air outlet, the second air outlet, the third air outlet, and the fourth air outlet may have a rectangular shape, and the fifth air outlet may be an air outlet having a rectangular shape in which one side of the opening edge formed by the first flow path member and one side of the opening edge formed by the second flow path member face each other in the width direction and a side extending in the width direction is formed by the first flow path member.

With this configuration, the part of the first flow path member and the part of the second flow path member constitute the fifth air outlet in a rectangular shape. Thus, the shape of the fifth air outlet is the same as the shape of the other first to fourth air outlets. Thus, wind speed variation can be suppressed more.

In the blowing device described above, the first flow path member may be fixed to the housing with a fastening member, and the fastening member may be inserted into a defining wall that defines the first air outlet and the second air outlet.

With this configuration, the fastening member is prevented from being disposed in the air outlet, and hence a pressure loss difference between the air outlets can be reduced.

The blowing device described above may further include a third flow path member being fixed to the housing downstream of the fan in the blowing direction and upstream of the first flow path member in the blowing direction, and including a sixth air outlet and a seventh air outlet, and an inlet surface including an inlet of the first flow path member and an air outlet surface including an air outlet of the third flow path member may be apart from each other.

With this configuration, the first flow path member and the third flow path member are disposed apart from each other in the blowing direction. Thus, a pressure loss can be adjusted, and a wind speed in accordance with an output of the fan and a state of the medium can be obtained. Further, the first flow path member and the third flow member are apart from each other. Thus, wind speed variation can be suppressed.

The blowing device described above may further include a heating unit configured to heat the medium, and the first flow path member and the second flow path member may be arranged apart from each other.

With this configuration, because of a heating unit, the first flow path member and the second flow path member are expanded in the width direction due to thermal expansion. However, the first flow path member and the second flow path member are disposed apart from each other, and hence wind speed variation is little even when both the flow path members are held in contact with each other due to thermal expansion. That is, the fifth air outlet between the first flow path member and the second flow path member opens in a space filled with heated gas. Thus, even when thermal expansion is caused, the opening is changed only at a small degree. Thus, wind speed variation can be suppressed.

A recording device includes the blowing device described above, and a recording unit configured to apply liquid to a medium.

With this configuration, a wind speed with respect to the medium applied with the liquid is uniformed, ability to dry the liquid is improved, and damage of the medium can be suppressed.

What is claimed is:

1. A blowing device for blowing air toward a medium to which liquid is applied, the medium being transported in a transport direction, the blowing device comprising:

a housing including a blowing path;

a fan configured to blow air, the fan being provided on the blowing path;

a first flow path member being fixed to the housing downstream of the fan in a blowing direction of the fan, and including a first air outlet and a second air outlet that are arranged in a width direction intersecting the transport direction; and a second flow path member being fixed to the housing downstream of the fan in the blowing direction, and including a third air outlet and a fourth air outlet that are arranged in the width direction, wherein the first flow path member and the second flow path member are fixed to the housing in a state of being arranged in the width direction, a fifth air outlet is formed between the first flow path member and the second flow path member that are fixed, and a part of an opening edge of the fifth air outlet is the first flow path member, and a part of the opening edge of the fifth air outlet is the second flow path member.

2. The blowing device according to claim 1, wherein the first air outlet, the second air outlet, the third air outlet, and the fourth air outlet have a rectangular shape, and the fifth air outlet is an air outlet having a rectangular shape where one side of the opening edge formed by the first flow path member and one side of the opening edge formed by the second flow path member face each other in the width direction and a side extending in the width direction is formed by the first flow path member.

3. The blowing device according to claim 1, wherein the first flow path member is fixed to the housing with a fastening member, and the fastening member is inserted into a defining wall that defines the first air outlet and the second air outlet.

4. The blowing device according to claim 1, comprising:

a third flow path member being fixed to the housing downstream of the fan in the blowing direction and upstream of the first flow path member in the blowing direction, and including a sixth air outlet and a seventh air outlet, wherein an inlet surface including an inlet of the first flow path member and an air outlet surface including an air outlet of the third flow path member are apart from each other.

5. The blowing device according to claim 1, comprising:

a heating unit configured to heat the medium, wherein the first flow path member and the second flow path member are arranged apart from each other.

6. A recording device, comprising:

the blowing device according to claim 1; and a recording unit configured to apply liquid to a medium.

* * * * *